US005184906A

United States Patent [19]

Czernik et al.

[11] Patent Number: 5,184,906

[45] Date of Patent: Feb. 9, 1993

[54] ADJUSTABLE ENVELOPE CASSETTE

[75] Inventors: Roman Czernik, Trumbull, Conn.; Francesco Porco, Bronx, N.Y.

[73] Assignee: Pitney Bowes Inc., Stamford, Conn.

[21] Appl. No.: 769,901

[22] Filed: Oct. 1, 1991

[51] Int. Cl.[5] ..... B41J 11/58

[52] U.S. Cl. ..... 400/629; 271/22; 271/127

[58] Field of Search ..... 400/629, 624, 633, 625; 271/2, 9, 22, 126, 127, 164, 160, 162

[56] References Cited

U.S. PATENT DOCUMENTS

| | | | |
|---|---|---|---|
| 3,919,972 | 11/1975 | Komori et al. | 271/118 |
| 4,032,137 | 6/1977 | Katayama et al. | 271/164 |
| 4,307,878 | 12/1981 | Kono | 271/22 |
| 4,343,461 | 8/1982 | Tomimori et al. | 271/22 |
| 4,359,215 | 11/1982 | Ruenzi | 271/22 |
| 4,372,547 | 2/1983 | Yanagawa et al. | 271/10 |
| 4,484,734 | 11/1984 | Tsudaka et al. | 271/9 |
| 4,509,734 | 4/1985 | Rutishauser | 400/629 |
| 4,679,953 | 7/1987 | Sone et al. | 400/629 |
| 4,780,740 | 10/1988 | Fukae | 355/3 SH |
| 4,861,017 | 8/1989 | Yamamoto et al. | 271/258 |
| 4,915,370 | 4/1990 | Himeji et al. | 271/162 |
| 4,991,830 | 2/1991 | Yamanaka | 271/127 |
| 5,005,820 | 4/1991 | Leemhuis | 271/127 |
| 5,013,025 | 5/1991 | Arai et al. | 271/164 |
| 5,052,673 | 10/1991 | Tokuda et al. | 271/22 |

FOREIGN PATENT DOCUMENTS

| | | | |
|---|---|---|---|
| 2329927 | 6/1973 | Fed. Rep. of Germany | 271/22 |
| 0084735 | 6/1980 | Japan | 271/22 |
| 0057147 | 4/1982 | Japan | 271/127 |
| 0189945 | 11/1982 | Japan | 271/127 |

*Primary Examiner*—Eugene H. Eickholt

*Attorney, Agent, or Firm*—Robert H. Whisker; Melvin J. Scolnick

[57] ABSTRACT

An adjustable cassette for use in an envelope printing system. The cassette includes an elevator for maintaining the top envelope in a stack of envelopes in contact with a take-up roller in the printing system. The cassette also includes lateral guides positioned adjacent to the extreme forward portion of the envelope stack. The lateral guides are resiliently mounted to depress and pass beneath the take-up roller as the cassette is inserted into the printing system.

20 Claims, 3 Drawing Sheets

ADJUSTABLE ENVELOPE CASSETTE

SUBJECT OF THE INVENTION

The subject invention relates to printing systems, and more particularly it relates to a cassette for use with a printing system for input of items to be printed which is adjustable to handle items having a range of sizes, such as envelopes. (As used herein the terms "printing system" and "printer" mean both printers per se, which convert input signals to printed indicia, copiers, which reproduce previously printed indicia, and like systems for producing printed indicia, with which cassettes for input of discreet items are used.)

Cassettes for use with laser printers and the like are well known. Such cassettes provide a simple and convenient manner by which an operator may change the type of item input to a printer. For example, simply by changing cassettes an operator may change input from 8 ½×11 cut sheets to legal size cut sheets or to an A sized cut sheet. It is also well known to use laser printers or the like to print addresses on envelopes. Accordingly, many printers are provided with a cassette for input of envelopes. However, since users are reluctant to purchase a number of cassettes to handle the wide variety of envelope sizes currently in use it has been found to be highly desirable to provide an envelope cassette which is adjustable for various envelope sizes. To date, however, it has not been possible to provide an envelope cassette which is adjustable over a wide range of envelope sizes.

To feed envelopes, or for that matter any item, into a printer satisfactorily it is generally necessary to provide lateral guide to assure that the items input are accurately and repeatably aligned with the printer as they are input. Of course, if the cassette is to be adjustable such lateral guides must be adjustable to accommodate items of various widths. However, since the lateral guides are adjustable it is possible that if they are mounted to far forward into the cassette that they will interfere with the take-up roller when the cassette is engaged with the printer. (As is known in the art printers generally include a take-up roller which bears upon the top item of a stack of items in a cassette and is driven by the printer to input the top item. The take-up roller generally extends across the full width of the printer input to accommodate the widest sheet to be input and are segmented. If only a single envelope size were used it would be possible to position the roller segments so that they would not interfere with the lateral guides when the cassette was engaged. However, where the lateral guides are adjustable, or where a multiplicity of fixed cassettes are used, this will generally not be possible.)

Because of this difficulty prior art adjustable envelope cassettes have positioned the lateral guides relatively far back in the cassette to avoid the possibility of interference with the take-up roller. This in turn has limited the range of envelope lengths for which the cassette can be adjusted. Because the lateral guides are positioned relatively far back in the cassette a relatively short item, such as a small envelope, may pass out of the control of the lateral guides before the leading edge is caught in the nip of the first pair of drive rollers, or the printer otherwise gains control of the registration of the item.

Accordingly, it is an object of the subject invention to provide an adjustable cassette for input of items such as envelopes to a printer which is adjustable over a wider range of sizes.

BRIEF SUMMARY OF THE INVENTION

The above objects are achieved, and the disadvantages of the prior art are overcome in accordance with the subject invention by means of a cassette which includes a tray and an apparatus (herein sometimes referred to as an elevator) mounted within the tray for supporting a stack of items for input to a printer and for maintaining the top item of the stack in contact with the take-up roller as the items are successively fed from the stack. The cassette also includes a pair of lateral guides for maintaining the lateral alignment of the items as they are fed from the cassette, the guides being mounted within the tray outboard of and proximate to the stack, at a position which is forward of the take-up roller when the cassette is engaged with the printer, and the tops of said guides being above the bottom of said taken-up roller. The guides are mounted in the cassette by resilient mountings which provide a capability for downward displacement. Thus the guides are deflected downwards to pass beneath the take-up roller as the cassette is engaged and disengaged with the printer.

Thus it can be seen that the subject invention achieves the above object by providing a cassette with lateral guides positioned forward of the take-up roller which do not interfere with the take-up roller as the cassette is engaged and disengaged. Other objects and advantages of the subject invention will be apparent to those skilled in the art from consideration of the detailed description set forth below and of the attached drawings.

DETAILED DESCRIPTION OF PREFERRED EMBODIMENTS OF THE SUBJECT INVENTION

Figure 1:
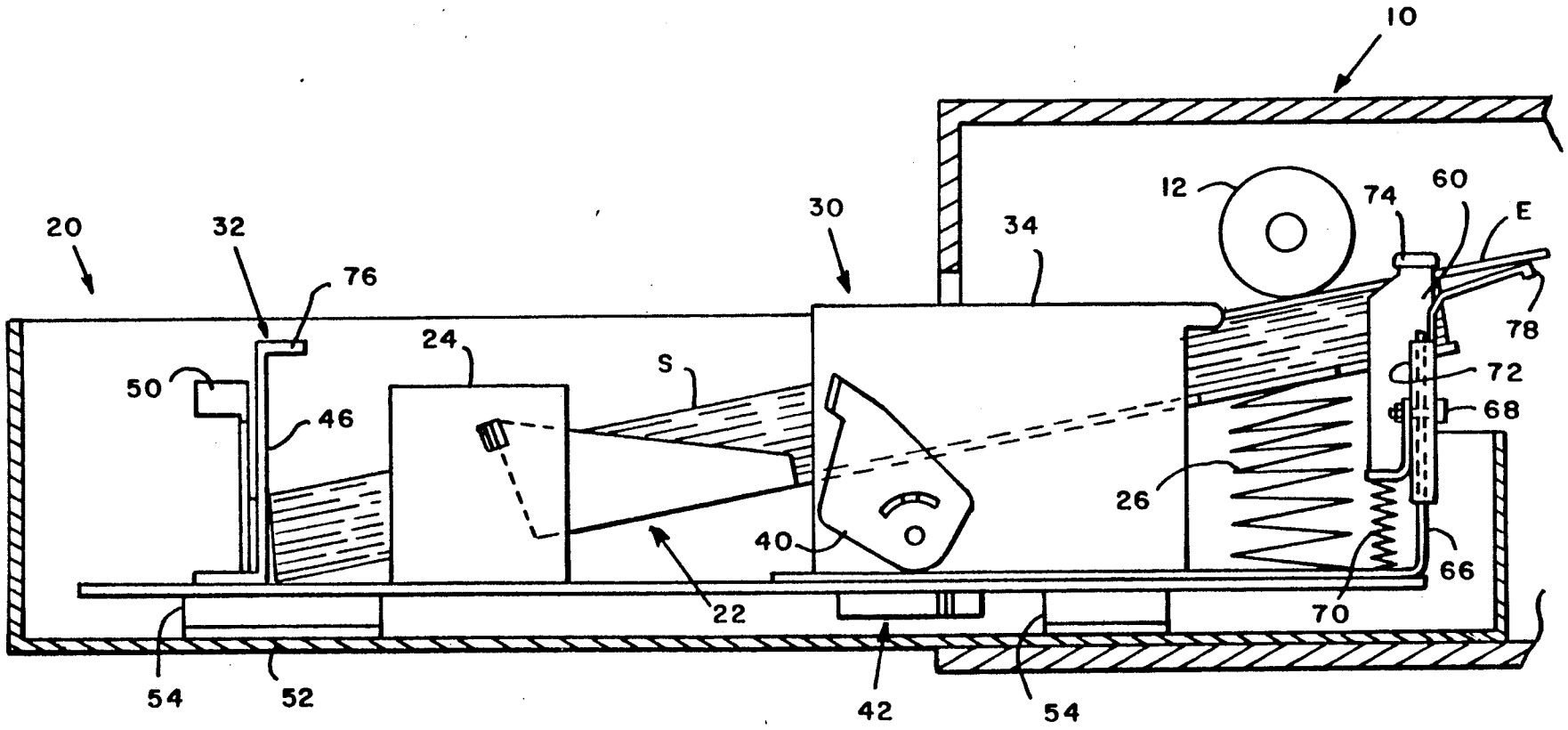
FIG. 1 is a semi-schematic cross-section view of a cassette in accordance with the subject invention shown in engagement with a printer, shown partially broken away.
Figure 2:
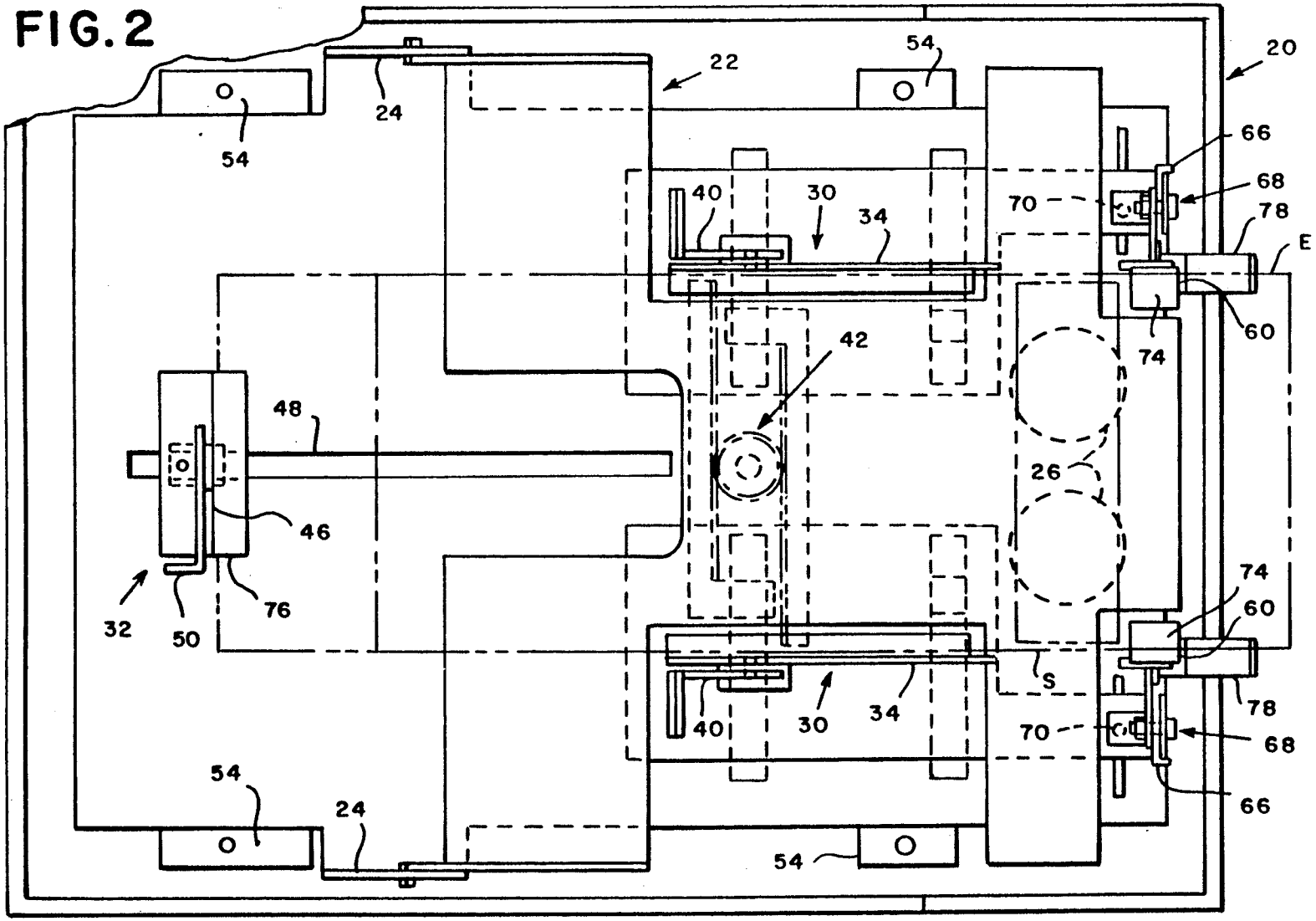
FIG. 2 is a top plan view of the cassette of FIG. 1.

Turning to FIGS. 1 and 2 a conventional printer 10 (shown in FIG. 1) includes a conventional take-up roller 12. Cassette 20 is shown in FIG. 1 in engagement with printer 10 so that take-up roller 12 bears upon the top envelope of stacks in a conventional manner to feed envelopes to printer 10 as is well known in the art.

Cassette 20 includes elevator assembly 22 which supports stack S in engagement with take-up roller 12. Elevator assembly 22 pivots on supports 24 which are positioned towards the rear of elevator assembly 22 and it is urged upwards by springs 26 to maintain the top envelope E in contact with take-up roller 12.

Cassette 20 also includes a pair of adjustable lateral guide assemblies 30. Assemblies 30 include rear lateral guides 34 which are positioned to the rear of take-up roller 12 to avoid interference. Assemblies 30 include locking cams 40 for locking assemblies 30 in place when they are positioned to provide lateral guidance for stack S. Assemblies 30 are supported on, and interconnected by, rack and pinion assembly 42, which constrains assemblies 30 so that they are always positioned symmetrically about the central axi of stack S, as is well known in the art.

Cassette 20 also includes stop 46 for aligning the rear edge of stack S. Stop 46 is moveable in slot 48 (shown in FIG. 2 and is held in place by locking cam 50.)

Mounts 24, assemblies 30, and assembly 32 are mounted in tray 52 by supports 54 in a conventional manner.

At the forward end of assemblies 30 guides 60 are mounted on a vertical member 66 by mounting assembly 68 and are resiliently supported by springs 70 so that guides 60 are free to move downwards in slot 72.

Figure 3:
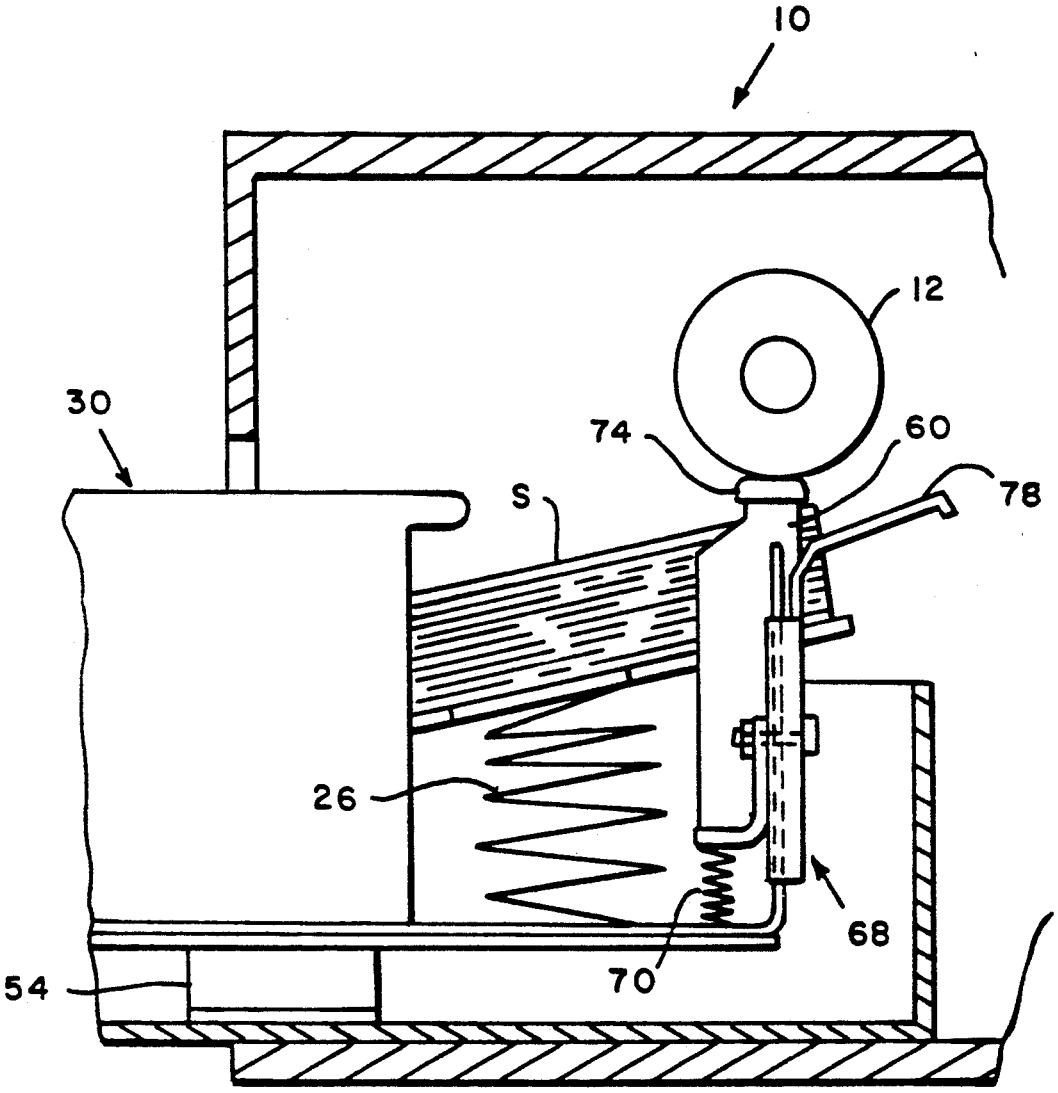
FIG. 3 is a detail of the displacement of the lateral guides as the cassette, shown partially broken away, is engaged with the printer, shown partially broken away.

Turning to FIG. 3 it can be seen that when assemblies 30 are adjusted for a size of stack S which has a width such that guides 60 would interfere with segments of take-up roller 12, roller 12 depresses guides 60 and compresses springs 70 so that guides 60 and stack S pass under roller 12 as cassette 20 is engaged with printer 10.

As noted, this allows guides 60 to be positioned in an extreme forward position so that lateral guidance is provided to an envelope E as it is fed from stack S (as seen in FIG. 1). This allows envelopes, or other items, as short as 6 ½ inches to be provided with lateral guidance until they are engaged by lateral guides or feed rollers of printer 10, so that an accurate alignment of envelope E is maintained. Thus cassette 20 is adjustable for an envelope lengths from 6.5 inches to 11 inches and for envelope widths from 3.625 inches to 6.5 inches.

Returning to FIGS. 1 & 2 guides 60 include tabs 74 which bear on the top sheet of stack S, and stop 46 includes a tab 76, which also bears on the top envelope of stack S. Tabs 74 and 76 cooperate to hold stack S down when it includes cassette's 20 maximum capacity (approximately 70 envelopes) so that the top envelopes in stack S do not rise above the top of lateral guides 34 before cassette 20 is engaged with printer 10.

While the use of such tabs for this purpose is known in the art, the extreme forward position of tabs 74 has been found to greatly facilitate loading stack S onto elevator 22 since it is no longer necessary to maneuver stack S under tabs which are positioned far enough back to avoid interference with roller 12.

Cassette 20 also includes supports 78 for supporting envelope E as it is fed from stack S to printer 10.

The above embodiments of the subject invention have been described by way of illustration only, and other embodiments of the subject invention will be apparent to those skilled in the art from consideration of the above description and the attached drawings. Accordingly, limitations on the subject invention are to be found only in the claims set forth below.

What is claimed is:

1. A cassette for selective engagement and disengagement with a printer, said printer including a mechanism for successively feeding items from said cassettes, comprising:

a. tray;

b. elevator means mounted within said tray for supporting a stack of items for input to said printer and for maintaining the top item of said stack in contact with the bottom of said mechanism as said items are successively fed from said stack; and c. a pair of guides for maintaining lateral alignment of said items as they are fed from said cassette, said guides being mounted within said tray outboard of and proximate to said stack and at a position which is forward of said mechanism when said cassette is engaged with said printer, the tops of said guides being above the bottom of said mechanism; said guides further comprising;

d. resilient mounting means for providing said guides with a capability for downward displacement, whereby said guides are deflected downwards to pass beneath said mechanism as said cassette is engaged and disengaged with said printer.

2. A cassette as described in claim 1 wherein said mounting means further comprises means for lateral adjustment of said guides for accommodation of items of varying width.

3. A cassette as described in claim 1 wherein said lateral adjustment means further comprises means for maintaining said guides in a symmetrical relationship about the centerline of said elevator means.

4. A cassette as described in claims 2 or 3 further comprising an adjustable stop for accommodation of items of varying length.

5. A cassette as described in claim 4 wherein said stop is adjustable over a range of approximately three inches.

6. A cassette as described in claim 5 wherein said guides include horizontal elements for engaging the top of said stack and limiting the height to which said stack can rise.

7. A cassette as described in claim 4 wherein said guides include horizontal elements for engaging the top of said stack and limiting the height to which said stack can rise.

8. A cassette as described in claim 4 wherein said items are envelopes.

9. A cassette as described in claim 1, 2 or 3 wherein said items are envelopes.

10. A cassette as described in claim 1, 2, or 3 wherein said guides include horizontal elements for engaging the top of said stack and limiting the height to which said stack can rise.

11. In a printing system for printing items, said system including a printer having a mechanism for feeding successive items into said printer, a cassette for maintaining a stack of items in operative engagement with said mechanism, said cassette comprising:

a. tray;

b. elevator means mounted within said tray for supporting a stack of items for input to said printer and for maintaining the top item of said stack in contact with the bottom of said mechanism as said items are successively fed from said stack, and, c. a pair of guides for maintaining lateral alignment of said items as they are fed from said cassette, said guides being mounted within said tray outboard of and proximate to said stack and at a position which is forward of said mechanism when said cassette is engaged with said printer, the tops of said guides being above the bottom of said mechanism; said guides further comprising;

d. resilient mounting means for providing said guides with a capability for downward displacement, whereby said guides are deflected downwards to pass beneath said mechanism as said cassette is engaged and disengaged with said printer.

12. A cassette as described in claim 11 wherein said mounting means further comprises means for lateral adjustment of said guides for accommodation of items of varying width.

13. A cassette as described in claim 12 wherein said lateral adjustment means further comprises means for maintaining said guides in a symmetrical relationship about the centerline of said elevator means.

14. A cassette as described in claims 11 or 13 further comprising an adjustable stop for accommodation of items of varying length.

15. A cassette as described in claim 14 wherein said stop is adjustable over a range of approximately three inches.

16. A cassette as described in claim 15 wherein said guides include horizontal elements for engaging the top of said stack and limiting the height to which said stack can rise.

17. A cassette as described in claim 14 wherein said guides include horizontal elements for engaging the top of said stack and limiting the height to which said stack can rise.

18. A cassette as described in claim 14 wherein said items are envelopes.

19. A cassette as described in claim 11, 12 or 13 wherein said items are envelopes.

20. A cassette as described in claim 11, 12 or 13 wherein said guides include horizontal elements for engaging the top of said stack and limiting the height to which said stack can rise.

* * * * *